US006874269B2

(12) United States Patent
Chen et al.

(10) Patent No.: US 6,874,269 B2
(45) Date of Patent: Apr. 5, 2005

(54) CONNECTING DEVICE FOR WEAPON ACCESSORY

(75) Inventors: Tony K. T. Chen, Taoyuan (TW); Ming-Chung Chiu, Keelung (TW); Wun-Chun Liou, Shrlin Chiu (TW); Chao-Hung Wu, Keelung (TW)

(73) Assignee: Quarton, Inc. (TW)

( * ) Notice: Subject to any disclaimer, the term of this patent is extended or adjusted under 35 U.S.C. 154(b) by 48 days.

(21) Appl. No.: 10/336,328

(22) Filed: Jan. 3, 2003

(65) Prior Publication Data

US 2004/0128900 A1 Jul. 8, 2004

(51) Int. Cl.[7] ..... F41C 27/00
(52) U.S. Cl. ..... 42/85; 42/106
(58) Field of Search ..... 42/85, 106

(56) References Cited

U.S. PATENT DOCUMENTS 3,986,285 A * 10/1976 Krisay ..... 42/127
4,383,371 A * 5/1983 Coffey ..... 42/124
4,776,126 A * 10/1988 Williams ..... 42/125
4,845,871 A * 7/1989 Swan ..... 42/127
5,033,219 A * 7/1991 Johnson et al. ..... 42/115
5,092,071 A * 3/1992 Moore ..... 42/85
5,343,650 A * 9/1994 Swan ..... 42/117
5,375,361 A * 12/1994 Rustick ..... 42/125
5,467,552 A * 11/1995 Cupp et al. ..... 42/125
5,533,292 A * 7/1996 Swan ..... 42/123
5,606,818 A * 3/1997 Hardee ..... 42/124
5,680,725 A * 10/1997 Bell ..... 42/127
5,694,712 A * 12/1997 Plonka ..... 42/124
5,737,866 A * 4/1998 Minaire et al. ..... 42/90
5,787,630 A * 8/1998 Martel ..... 42/125
5,806,228 A * 9/1998 Martel et al. ..... 42/124
5,896,850 A * 4/1999 Sullivan, Jr. ..... 124/74
5,941,489 A * 8/1999 Fanelli et al. ..... 248/298.1
6,385,892 B1 * 5/2002 Vendetti ..... 42/86
6,421,946 B1 * 7/2002 LoRocco ..... 42/111
6,449,893 B2 * 9/2002 Spinner ..... 42/127
6,594,938 B2 * 7/2003 Horton ..... 42/127
6,606,813 B1 * 8/2003 Squire et al. ..... 42/90
6,629,381 B1 * 10/2003 Keng ..... 42/124

* cited by examiner

*Primary Examiner*—Jack Keith
*Assistant Examiner*—John Richardson
(74) *Attorney, Agent, or Firm*—Raymond Sun

(57) ABSTRACT

A connecting device for a weapon accessory has a seat having a sliding rack that removably connects the longitudinal groove of a weapon, and one or more gripping blocks disposed adjacent corresponding side walls of the seat. The gripping block assumes a first position where the gripping block extends inwardly towards the sliding rack to engage a selected transverse groove of the weapon, and a second position where the gripping block extends outwardly away from the respective side wall of the seat to release the longitudinal groove of the weapon. The connecting device also includes a control mechanism operatively coupled to the gripping block. The control mechanism assumes a normal position with the control mechanism controlling the gripping block to maintain the gripping block in the first position, and actuation of the control mechanism causes the gripping block to assume the second position.

19 Claims, 16 Drawing Sheets

CONNECTING DEVICE FOR WEAPON ACCESSORY

BACKGROUND OF THE INVENTION

1. Field of the Invention

The invention relates to weapon accessories, and in particular, to a connecting device for connecting an accessory to a weapon (such as a pistol).

2. Description of the Prior Art

Weapons, such as pistols, shotguns and rifles, among others, are often used with accessories (such as aiming devices) that assist the user in the use of the weapon. These accessories are removably secured to the weapon by a connecting device. There have been many connecting devices that have been provided in the prior arts.

FIGS. 1 and 2 illustrate one conventional connecting device for a weapon accessory. The conventional connecting device comprises a main body 11 for receiving a weapon accessory 40, which is typically a laser aiming device. The conventional connecting device has a groove 111 on the bottom side of the main body 11 that matches one of a plurality of grooves 31 on the corresponding side of the weapon 30. The main body 11 is secured within the selected groove 31 by screwing square bolts 12 through corresponding grooves 111 and 31 into corresponding washers 13 and nuts 14. The grooves 31 are typically arranged to be perpendicular to the barrel 32 of the gun and are arranged in series along the axis of the barrel 32.

Unfortunately, the conventional connecting devices (including but not limited to that illustrated in FIGS. 1 and 2) for weapon accessories suffer from several drawbacks:

(a) The construction of certain conventional connecting devices is complex, so it can be difficult and time-consuming to assemble or disassemble the connecting device, and to secure the connecting device to the weapon. The complex construction also results in increased manufacturing and material costs.

(b) Close manufacturing tolerances may be required. In the connecting device of FIGS. 1 and 2, the connection of the main body 11 and the inner diameter of the selected groove 31 by the square bolt 12 requires precise tolerances. If the inner diameter of the groove 31 varies, or the size of the bolt 12 varies, the connection can be difficult to accomplish. For example, the main body 11 may not be securely attached to the groove 31, or it may be difficult to screw the square bolt 12 into the groove 31.

Thus, there still remains a need for a connecting device for a weapon accessory that overcomes the drawbacks set forth above.

SUMMARY OF THE DISCLOSURE

It is one objective of the present invention to provide a connecting device for a weapon accessory that can reliably secure an accessory to the weapon.

It is another objective of the present invention to provide a connecting device for a weapon accessory that can be quickly and conveniently secured to and removed from the weapon.

It is yet another objective of the present invention to provide a connecting device for a weapon accessory which can be engaged or disengaged with the weapon by manipulating one elastic mechanism.

In order to accomplish the objectives of the present invention, the present invention provides a connecting device for a weapon accessory. The connecting device has a seat having a sliding rack that removably connects the longitudinal groove of a weapon, and one or more gripping blocks disposed adjacent corresponding side walls of the seat. The gripping block assumes a first position where the gripping block extends inwardly towards the sliding rack to engage a selected transverse groove of the weapon, and a second position where the gripping block extends outwardly away from the respective side wall of the seat to release the longitudinal groove of the weapon. The connecting device also includes a control mechanism operatively coupled to the gripping block. The control mechanism assumes a normal position with the control mechanism controlling the gripping block to maintain the gripping block in the first position, and actuation of the control mechanism causes the gripping block to assume the second position.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
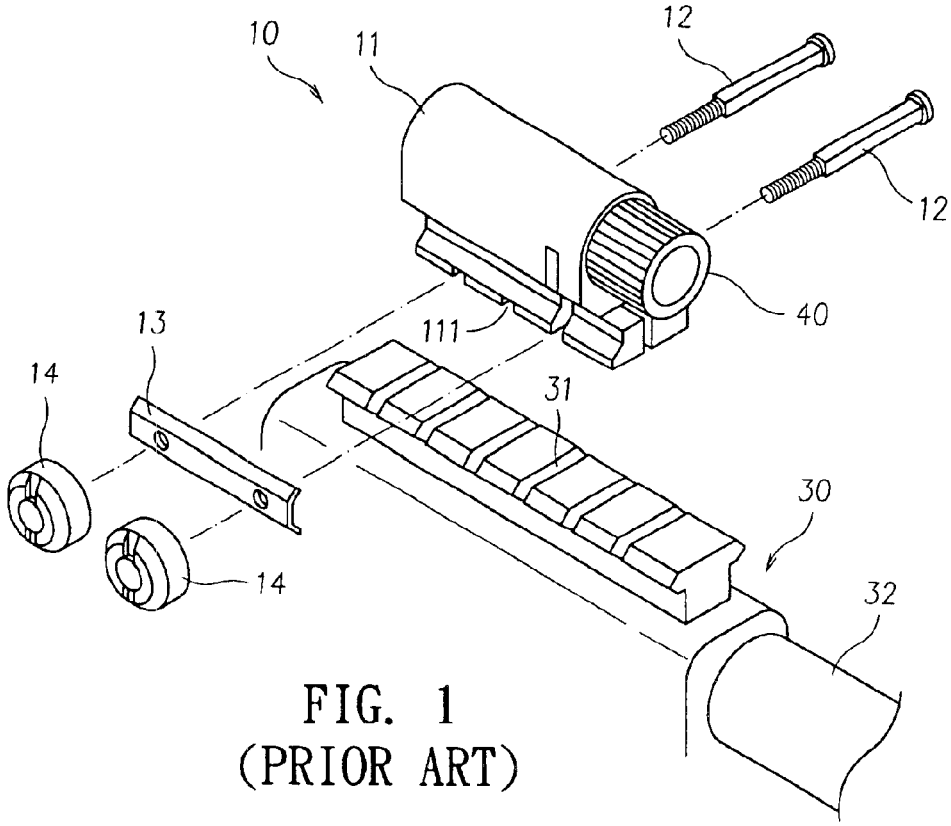
FIG. 1 (PRIOR ART)
FIG. 1 is an exploded perspective view illustrating how a conventional connecting device is secured to a weapon, such as a pistol.
Figure 2:
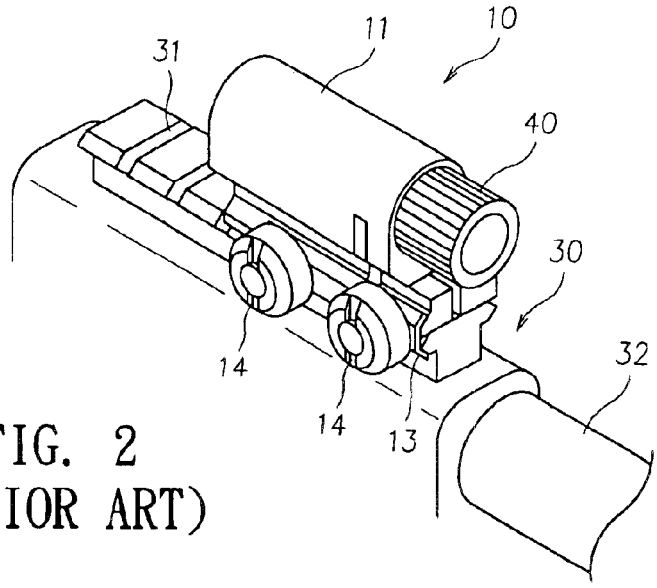
FIG. 2 (PRIOR ART)
FIG. 2 is a perspective view illustrating the conventional connecting device of FIG. 1 secured to a weapon.
Figure 3:
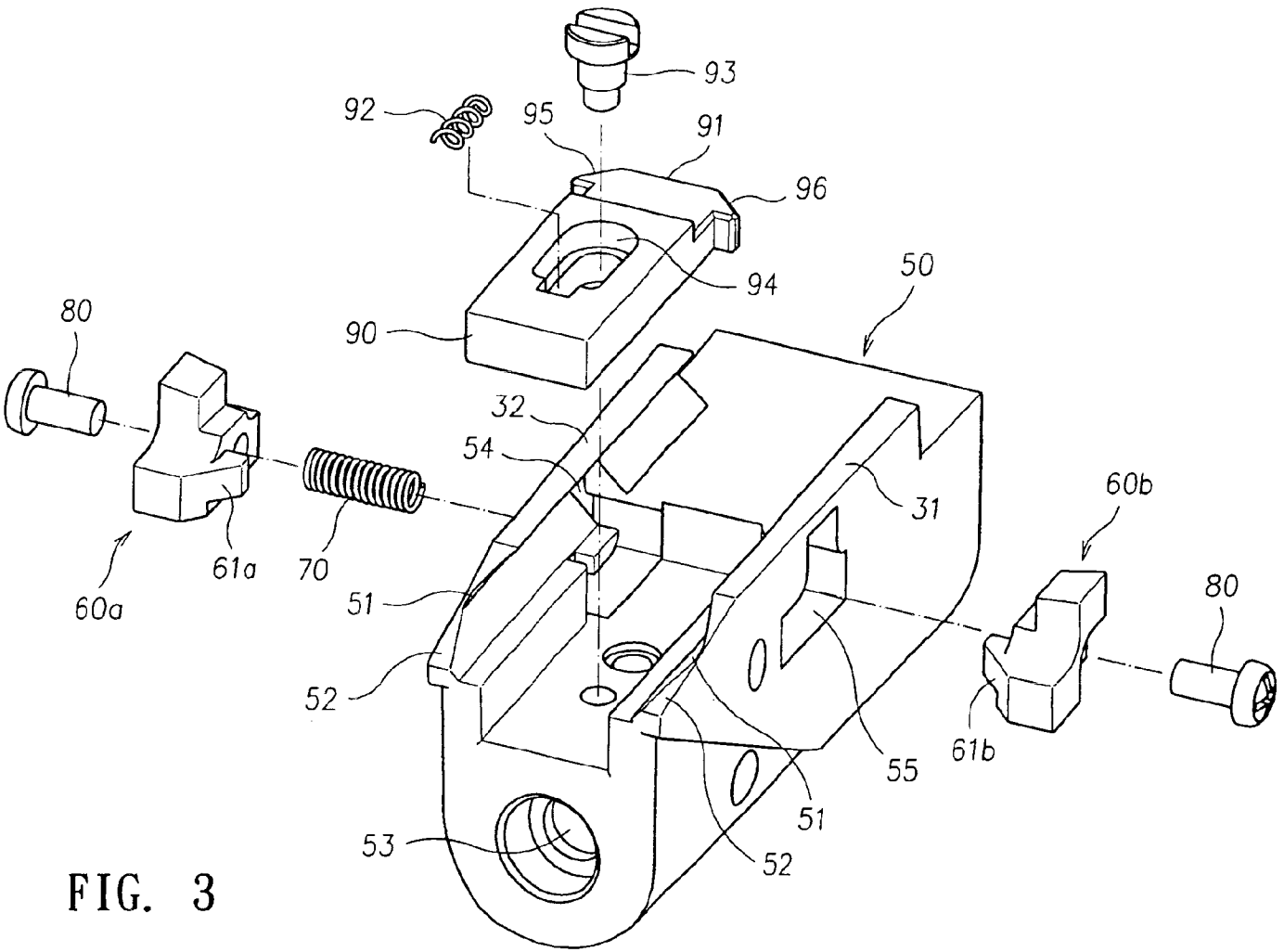
FIG. 3 is an exploded perspective view of a connecting device according to one embodiment of the present invention.
Figure 4:
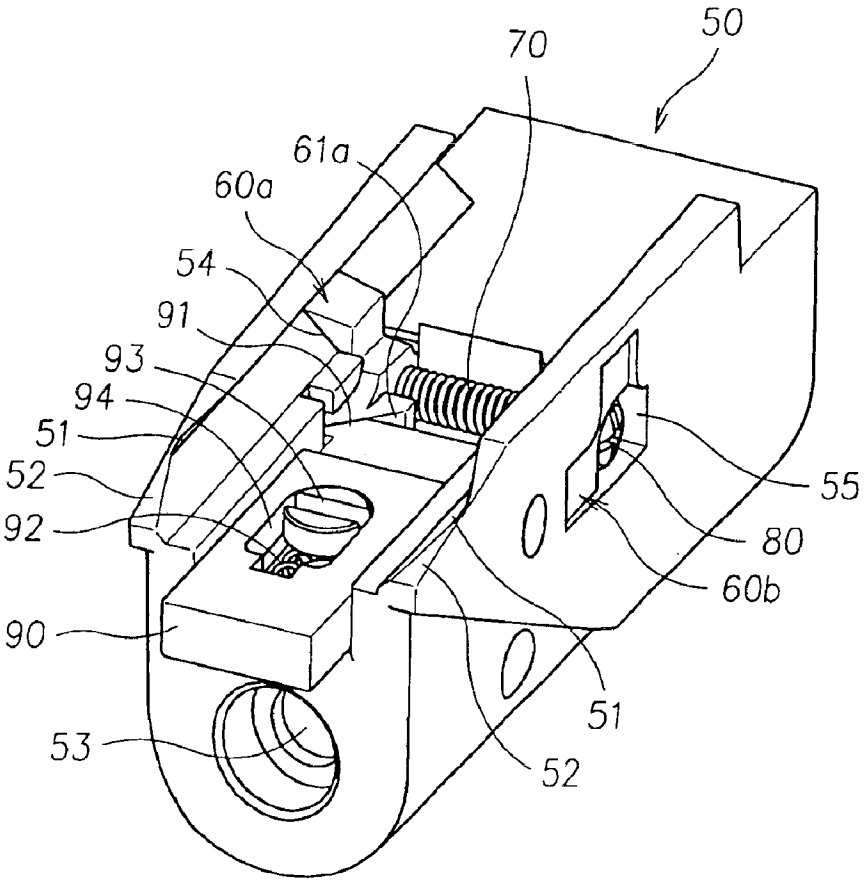
FIG. 4 is a perspective view of the connecting device of FIG. 3.

FIGS. 3 and 4 illustrate one embodiment of a connecting device according to the present invention. The connecting device has a seat 50, two sliding blocks 60*a* and 60*b*, and a control mechanism.

The seat 50 has a left side wall 31 and a right side wall 32. Sliding racks 51 are provided adjacent the top of the side walls 31, 32. A front surface 52 is provided at the front of the side walls 31, 32. Each side wall 31 and 32 has a corresponding opening 55 and 54, respectively, that are aligned with each other.

Each sliding block 60*a* and 60*b* is fitted through a corresponding opening 54 and 55, respectively, of the corresponding side wall 32 and 31, respectively. Each sliding block 60*a* and 60*b* performs a gripping function, as described below. An inwardly-biased elastic component 70 (such as a spring) is positioned between the two sliding blocks 60*a* and 60*b*. Corresponding bolts 80 can be inserted through each sliding block 60*a* and 60*b*, and through the elastic component 70, to connect the sliding blocks 60*a* and 60*b* to each other.

Figure 5A:
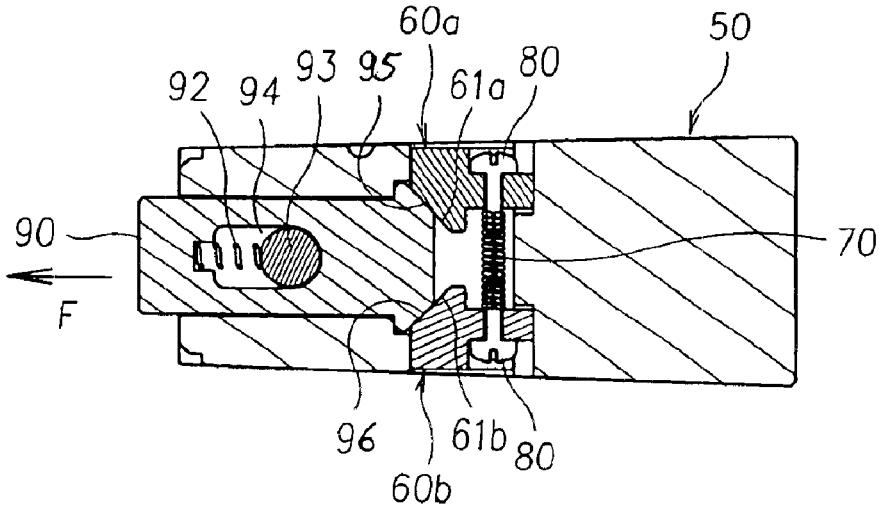
FIG. 5A is a top cross-sectional plan view of the connecting device of FIG. 3 shown with the control mechanism in the normal position.
Figure 5B:
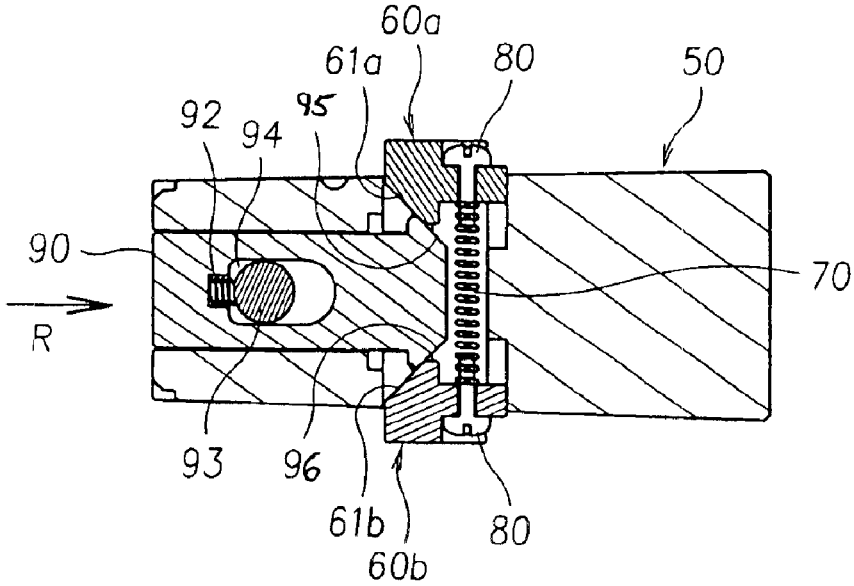
FIG. 5B is a top cross-sectional plan view of the connecting device of FIG. 3 shown with the control mechanism being pressed.
Figure 6A:
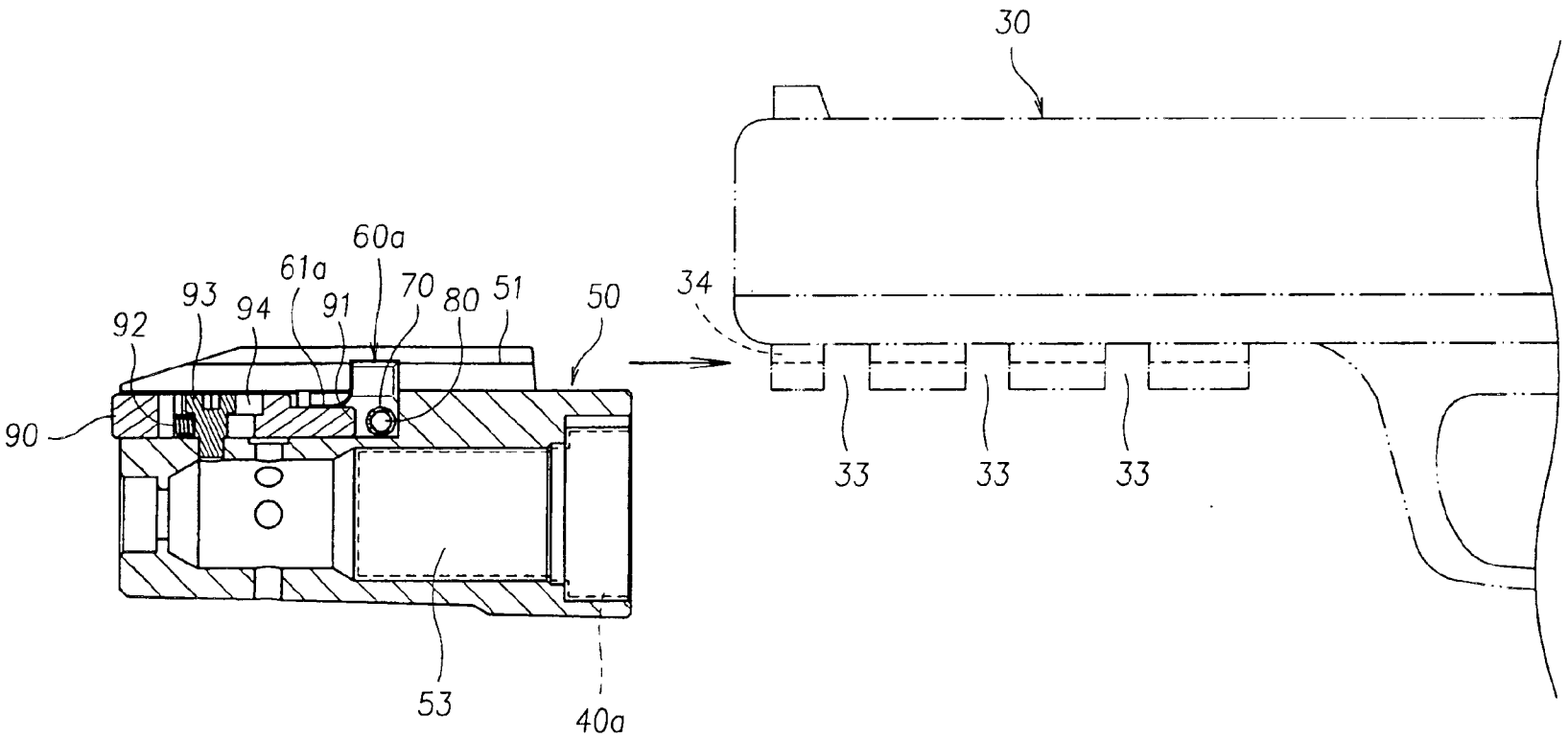
FIG. 6A is a side cross-sectional plan view of the connecting device of FIG. 3 shown prior to engaging a pistol.
Figure 6B:
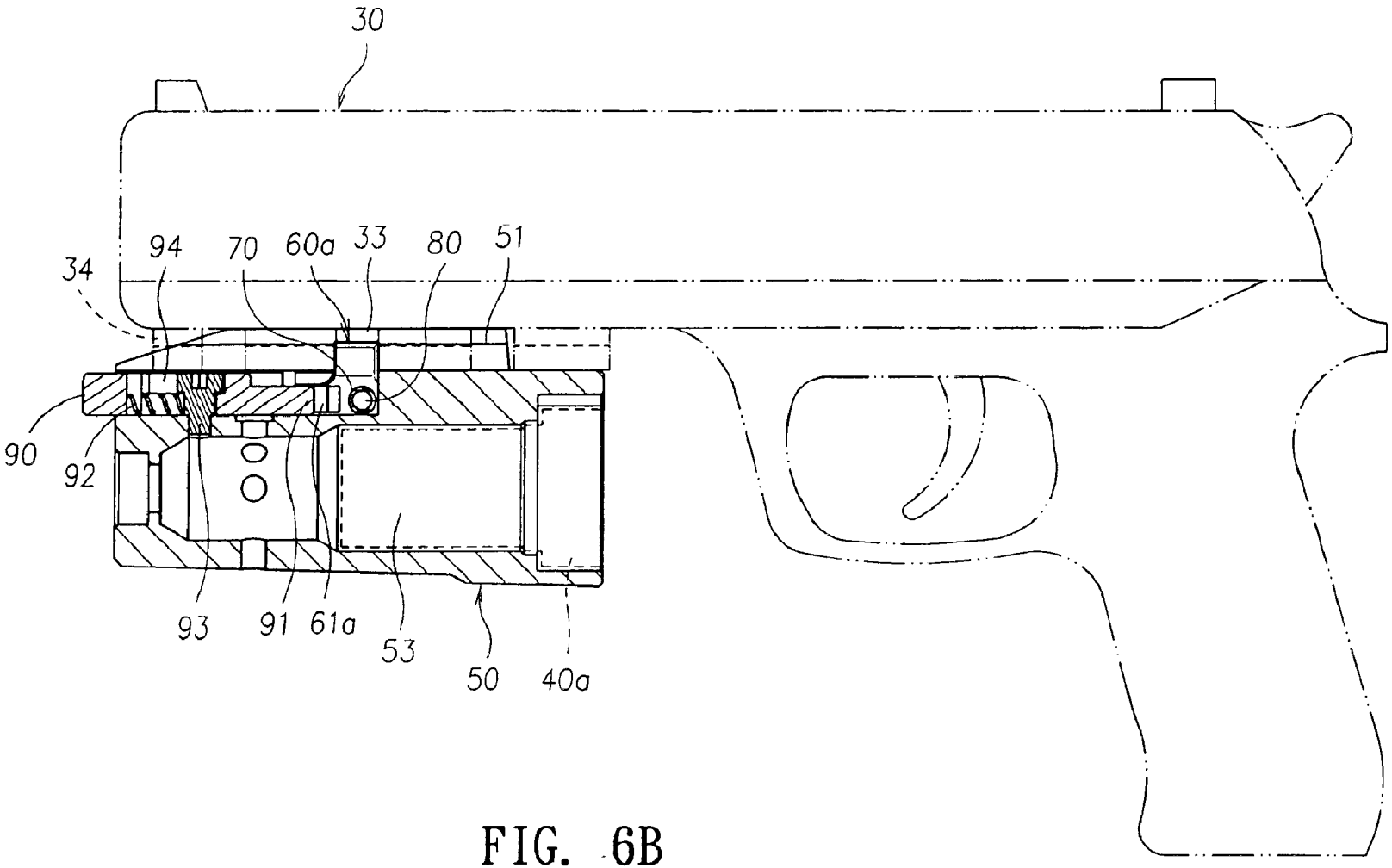
FIG. 6B is a side cross-sectional plan view of the connecting device of FIG. 3 shown after it has engaged a pistol.

The control mechanism can be a button 90 which can be secured between the side walls 31, 32 of the seat 50 by a screw 93 that is inserted through an elongated hole 94 in the button 90 and secured to the seat 50 at a fixed location. The provision of the elongated hole 94 with the fixed screw 93 means that the button 90 can move back and forth along the top of the seat 50, with the fixed screw 93 defining the opposing limits of movement of the button 90. Referring also to FIGS. 5A, 5B, 6A and 6B, an outwardly-biased elastic component 92 (such as a spring) is positioned in the elongated hole 94, and between the screw 93 and the front of the button 90, to exert a normal outward bias against the button 90 to push the button 90 forward in the direction of the arrow F. The button 90 also has a rear portion 91 having outwardly-extending angled surfaces 95 and 96 that are adapted to engage the sliding blocks 60*a* and 60*b*, respectively. In particular, as will be explained greater detail below, the angled surfaces on the rear portion 91 and the sliding blocks 60*a* and 60*b* are adapted to engage each other. Referring to FIG. 5A, the inward natural bias of the elastic component 70 will pull the sliding blocks 60*a* and 60*b* towards each other when the button 90 is being normally outwardly biased by the elastic component 92 towards the front in the direction of arrow F. However, when the button 90 is pushed to the rear in the direction of arrow R (see FIG. 5B), the rear portion 91 of the button 90 will push the sliding blocks 60*a* and 60*b* away from each other (overcoming the normal inward bias of the elastic component 70) and cause the sliding blocks 60*a* and 60*b* to protrude away from the side walls 32 and 31, respectively. In other words, the button 90 and the two sliding blocks 60*a*, 60*b* are operatively engaged by pressing or releasing the button 90.

Figure 7C:
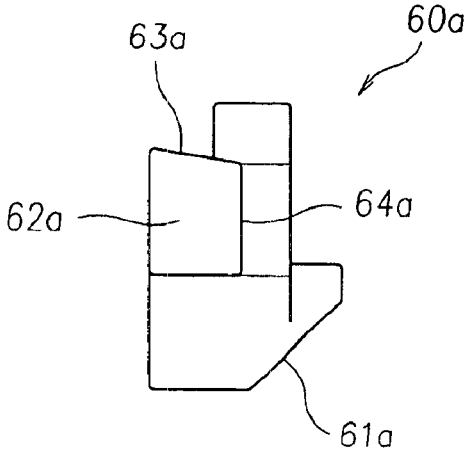
FIG. 7C is a top plan view of the sliding block of FIG. 7A.
Figure 7A:
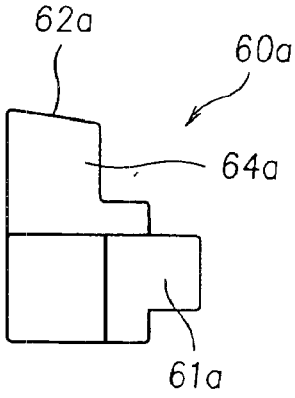
FIG. 7A is a front plan view of a sliding block of the connecting device of FIG. 3.
Figure 7B:
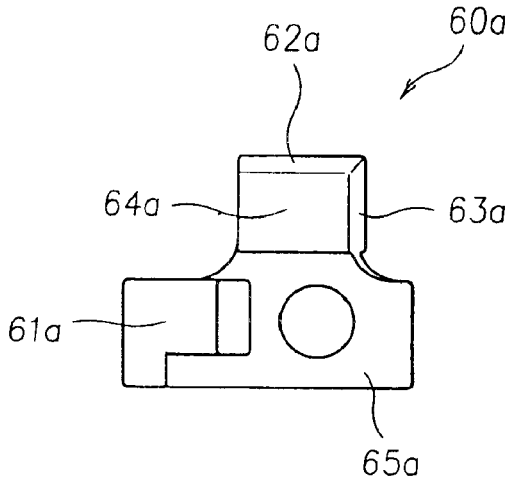
FIG. 7B is a side plan view of the sliding block of FIG. 7A.

The sliding block 60*a* is illustrated in greater detail in FIGS. 7A–7C. The sliding block 60*b* is identical to the sliding block 60*a* but oriented in the opposite orientation. Thus, only the sliding block 60*a* is described and illustrated in connection with FIGS. 7A–7C. The elements of the sliding block 60*b* bear the same numerals as the elements of the sliding block 60*a* described above, except that a "b" is used in the numeral designations for the sliding block 60*b* instead of an "a".

The sliding block 60*a* has a horizontal section 65*a* and a vertical section 64*a* extending perpendicularly from the top of the horizontal section 65*a*. A first inwardly-extending angled surface 61*a* is provided at one end of the sliding block 60*a*, and is aligned with the outwardly-extending angled surface 95 of the button 90. Similarly, the sliding block 60*b* has a first inwardly-extending angled surface 61*b* that is aligned with the outwardly-extending angled surface 96 of the button 90. The vertical section 64*a* of the sliding block 60*a* has an angled top surface 62*a* that communicates with an angled side surface 63*a*. The inclination of the angled surfaces 62*a* and 63*a* extends from the outer side of the sliding block 60*a* to inner side, so that the vertical section 64*a* can act as an engaging member of the sliding block 60*a* that is used to engage the transverse groove 33 of the weapon 30 (see also FIGS. 5A–6B).

FIGS. 5A–6B illustrate how the connecting device of the present invention is attached to a weapon 30. A weapon accessory 40*a* (such as an aiming device, which can be a conventional laser sight) is positioned inside a bore 53 of the seat 50. First, the button 90 is pressed rearwardly in the direction of arrow R to separate the two sliding blocks 60*a* and 60*b*, causing the sliding blocks 60*a*, 60*b* to extend out of the side walls 31, 32 (see FIG. 5B). The provision of the surface 52 adjacent the front of the seat 50 (which is the end of the seat 50 that faces the grooves 34 when the connecting device is attached to the weapon 30) makes it easier to slide the sliding rack 51 of seat 50 into the longitudinal groove 34 of the weapon 30. The position of the seat 50 can then be adjusted within the longitudinal groove 34 to the selected transverse groove 33, and then releasing the button 90 will allow the sliding blocks 60*a* and 60*b* to be biased towards each other so as to be engaged into the selected transverse groove 33. In particular, when the button 90 is released, the natural outward bias of the elastic component 92 will push the button 90 forward in the direction of the arrow F (see FIG. 5A), and the natural inward bias of the elastic component 70 will pull the two sliding blocks 60*a*, 60*b* towards each other to exert a gripping force. Also, with the elastic component 70 disposed between the sliding blocks 60*a* and 60*b*, the depth of the engagement (of the two sliding blocks 60*a* and 60*b* into the selected transverse groove 33) is adjusted automatically depending upon the width of the transverse groove 33. This automatic adjustment provides a more secure attachment.

To remove the seat 50 from the longitudinal groove 34, the user merely presses the button 90 so that the sliding blocks 60*a*, 60*b* release their grip on the longitudinal groove 34, and the user simply slides the seat 50 off the longitudinal groove 34.

Thus, in the present invention, the two sliding blocks 60*a* and 60*b* are slid into the transverse groove 33 from two opposing sides (i.e., side walls 31, 32) of the seat 50, with the two sliding blocks 60*a* and 60*b* providing a gripping force to grip the transverse groove 33. By gripping the longitudinal groove 34 from two sides, the seat 50 can be more securely and effectively connected with the weapon 30, and minimizes the shaking that the seat 50 might otherwise experience, so as to improve the weapon's aiming precision. In addition, the present invention only requires the pressing and releasing of one button to attach and detach, respectively, the seat 50 from the weapon 30, thereby facilitating convenient, quick and effective deployment of the connecting device.

Figure 8A:
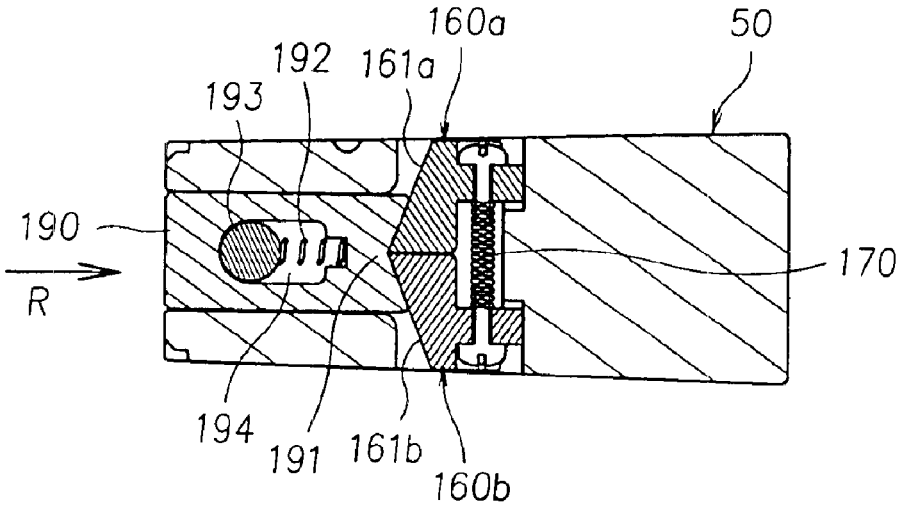
FIG. 8A is a top cross-sectional plan view of the connecting device of FIG. 3 shown with a control mechanism and sliding block according to another embodiment in the normal position.
Figure 8B:
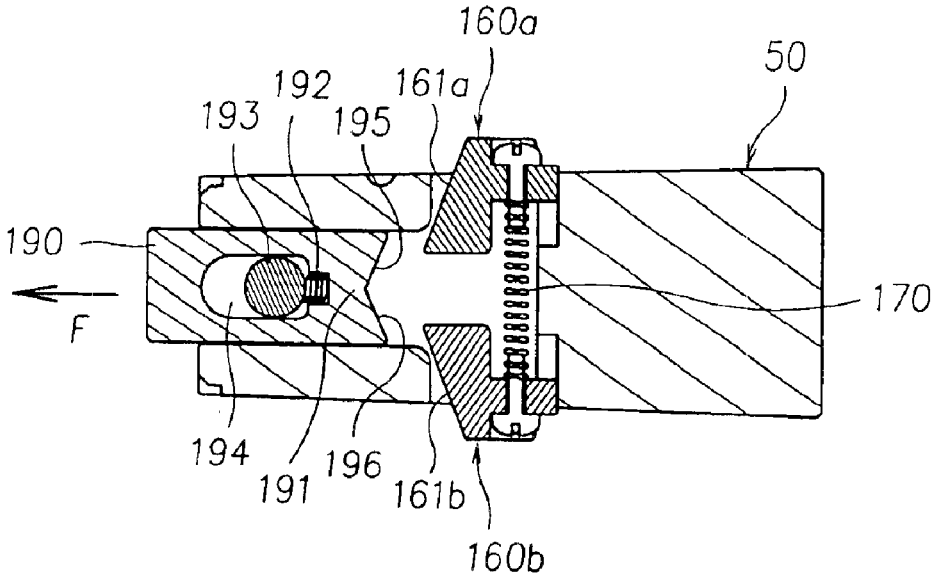
FIG. 8B is a top cross-sectional plan view of the connecting device of FIG. 8A shown with the control mechanism being actuated.

FIGS. 8A and 8B illustrate another button 190 that can be utilized with the same seat 50 in FIGS. 1–6B above. The button 190 also has a fixed screw 193 that is inserted through an elongated hole 194 in the button 190. An outwardly-biased elastic component 192 (such as a spring) is positioned in the elongated hole 194, and between the screw 193 and the rear of the button 190, to exert a normal bias against the button 190 to push the button 190 rearward in the direction of the arrow R. The button 190 also has a rear portion 191 having inwardly-extending angled surfaces 195 and 196. The sliding blocks 160*a* and 160*b* now have outwardly-extending angled surfaces 161*a* and 161*b*, respectively, that are aligned with (and adapted to engage) the inwardly-extending angled surfaces 195 and 196, respectively, on the button 190.

In use, the natural outward bias of the elastic component 170 will push the sliding blocks 160*a* and 160*b* away from each other. When the button 190 is normally biased by the elastic component 192 towards the rear in the direction of the arrow R (see FIG. 8A), the inwardly-extending angled surfaces 195 and 196 of the button 190 will engage the outwardly-extending angled surfaces 161*a* and 161*b*, respectively, overcoming the natural outward bias of the elastic component 170 so as to hold the sliding blocks 160*a* and 160*b* together. When the button 190 is pulled to the front in the direction of arrow F (see FIG. 8B), the inwardly-extending angled surfaces 195 and 196 of the button 190 will release the outwardly-extending angled surfaces 161*a* and 161*b*, respectively, so the natural outward bias of the elastic component 170 will push the sliding blocks 160*a* and 160*b* away from each other and cause the sliding blocks 160*a* and 160*b* to protrude away from the side walls 32 and 31, respectively.

Figure 9A:
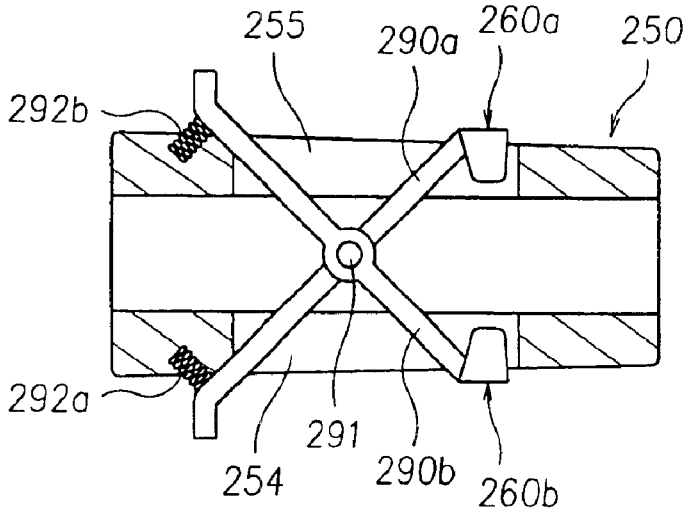
FIG. 9A is a top cross-sectional plan view of a connecting device according to another embodiment of the present invention shown with the control mechanism in the normal position.
Figure 9B:
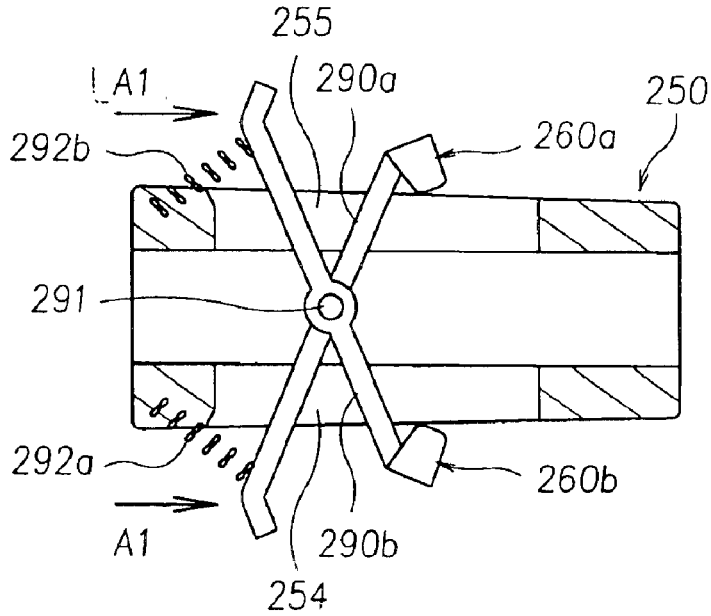
FIG. 9B is a top cross-sectional plan view of the connecting device of FIG. 9A shown with the control mechanism being actuated.
Figure 9C:
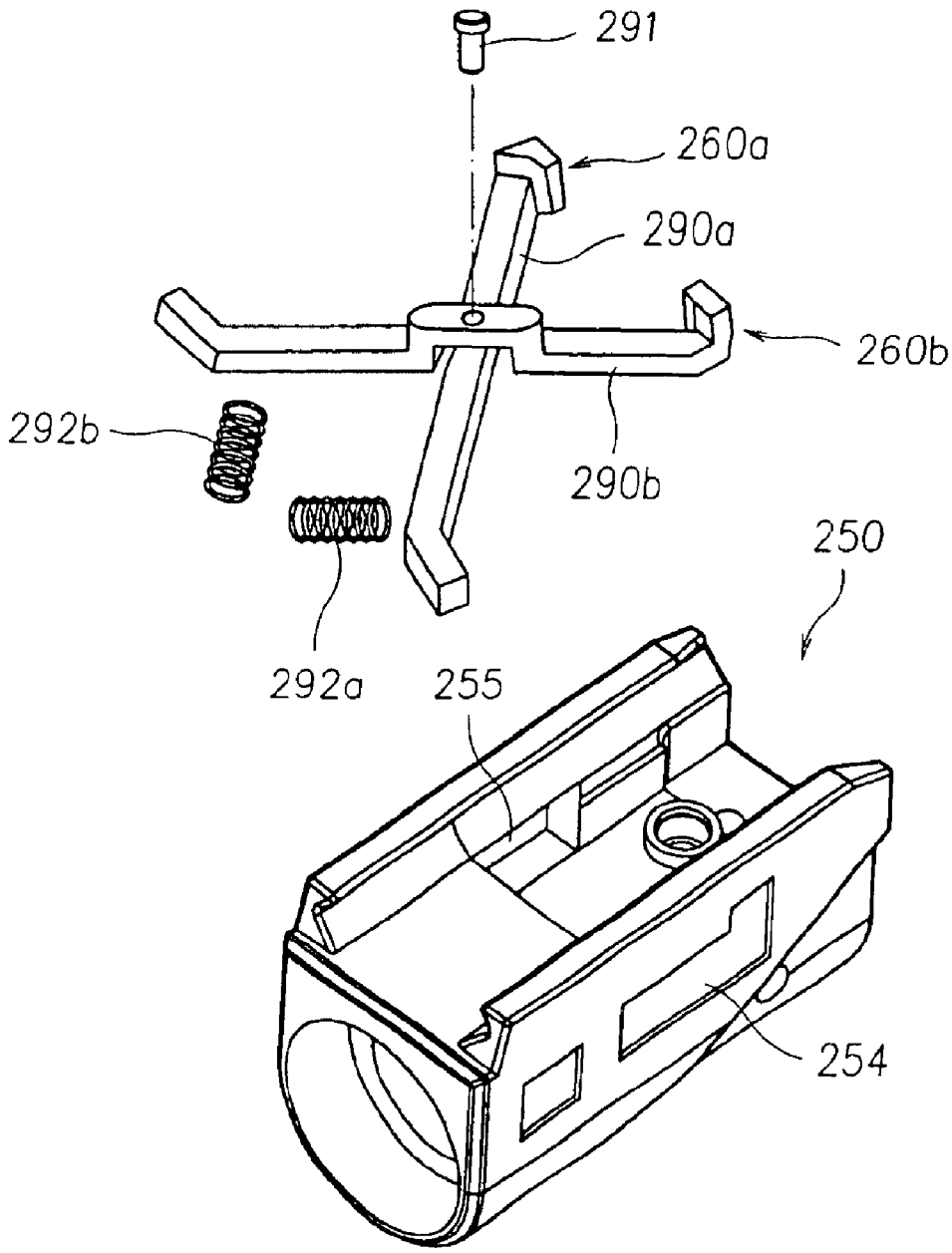
FIG. 9C is an exploded perspective view of the connecting device of FIG. 9A.

The control mechanism can be embodied in other constructions other than the buttons 90 and 190 described above. For example, FIGS. 9A–9C illustrate another embodiment of the present invention where the seat 250 is similar to the seat 50, except that the aligned openings 254 and 255 in the seat 250 have a different shape than the aligned openings 54 and 55 in the seat 50. In the embodiment in FIGS. 9A–9C, the control mechanism has two bars 290*a* and 290*b*, each having a gripping end 260*a* and 260*b*, respectively, that functions in the same manner as the sliding blocks 60*a* and 60*b*. The two bars 290*a* and 290*b* cross each other at about their mid-points at the location of a pivot pin 291 that pivotably couples the bars 290*a*, 290*b* and the seat 250. Inwardly-biased elastic components 292*a* and 292*b* (e.g., springs) are provided between the seat 250 and each end of the bars 290*a*, 290*b* opposite the gripping ends 260*a*, 260*b*. The elastic components 292*a*, 292*b* exert an inward bias to normally bias the bars 290*a*, 290*b* to the seat 250, as shown in FIG. 9A. FIG. 9A also shows that the two gripping ends 260*a*, 260*b* extend through the openings 254 and 255 into the seat 250, and are disposed closest to each other, when the bars 290*a*, 290*b* are in their normal position (when the bars 290*a*, 290*b* are biased towards the seat 250 by the elastic components 292*a*, 292*b*).

When the user pushes the bars 290*a*, 290*b* in the direction the arrows A1 in FIG. 9B against the normal bias of the elastic components 292*a*, 292*b*, the gripping ends 260*a*, 260*b* will move away from each other so that the longitudinal groove of the weapon 30 can be placed between the gripping ends 260*a*, 260*b*. When the user then releases the push on the bars 290*a*, 290*b*, the elastic components 292*a*, 292*b* will bias the ends 260*a*, 260*b* towards each other to grip a transverse groove 33 on the weapon 30. The grip on the transverse groove 33 can be released by pushing the bars 290*a*, 290*b* in the direction of the arrows A1 in FIG. 9B.

Figure 10A:
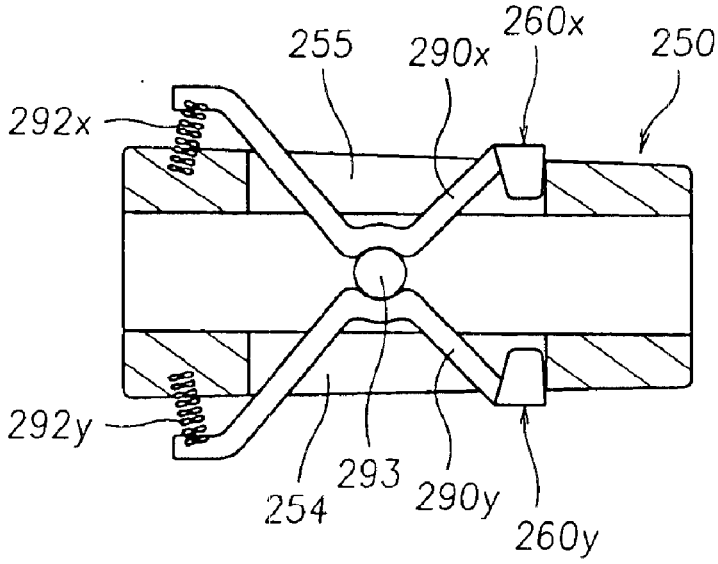
FIG. 10A is a top cross-sectional plan view of a connecting device according to another embodiment of the present invention shown with the control mechanism in the normal position.
Figure 10B:
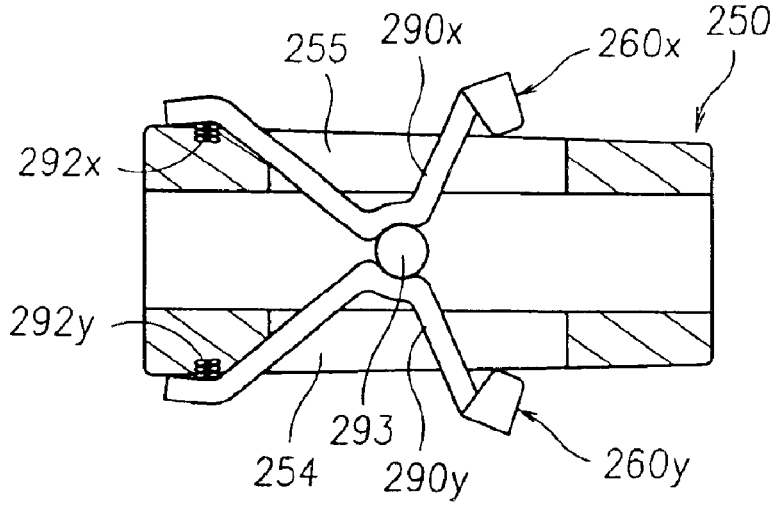
FIG. 10B is a top cross-sectional plan view of the connecting device of FIG. 10A shown with the control mechanism being actuated.
Figure 10C:
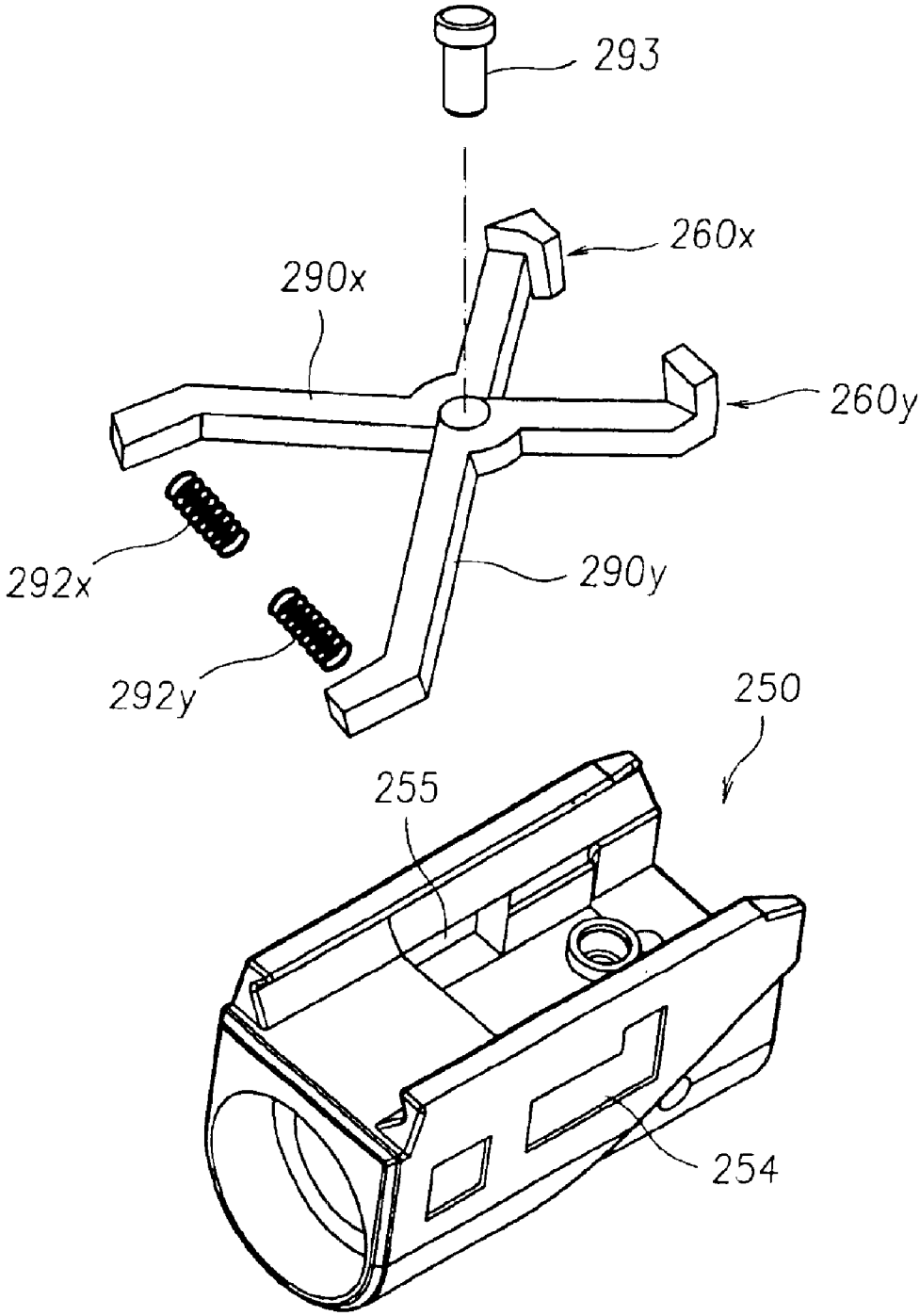
FIG. 10C is an exploded perspective view of the connecting device of FIG. 10A.

The control mechanism in FIGS. 10A–10C is essentially the same as in FIGS. 9A–9C, except that the two crossing bars 290*a*, 290*b* are now replaced by two generally V-shaped bars 290*x* and 290*y* that are positioned side-by-side and pivoted by a pivot pin 293 that is fixed in the seat 250. The same numerals are used in FIGS. 10A–10C to designate the same elements in FIGS. 9A–9C. Outwardly-biased elastic components 292*x* and 292*y* (e.g., springs) are provided between the seat 250 and each end of the bars 290*x*, 290*y* opposite the gripping ends 260*x*, 260*y*. The elastic components 292*x*, 292*y* normally bias the bars 290*x*, 290*y* away from the seat 250, as shown in FIG. 10A. FIG. 10A also shows that the two gripping ends 260*x*, 260*y* extend through the openings 254 and 255 into the seat 250, and are disposed closest to each other, when the bars 290*x*, 290*y* are in their normal position (when the bars 290*a*, 290*b* are biased away from the seat 250 by the elastic components 292*a*, 292*b*).

When the user presses the bars 290*x*, 290*y* towards the seat 250 in FIG. 10B against the normal bias of the elastic components 292*x*, 292*y*, the gripping ends 260*x*, 260*y* will move away from each other so that the longitudinal groove of the weapon 30 can be placed between the gripping ends 260*x*, 260*y*. When the user then releases the pressing force on the bars 290*x*, 290*y*, the elastic components 292*x*, 292*y* will bias the ends 260*x*, 260*y* towards each other to grip a transverse groove 33 on the weapon 30. The grip on the transverse groove 33 can be released by pressing the bars 290*x*, 290*y* towards the seat 250 as shown in FIG. 10B.

Figure 11A:
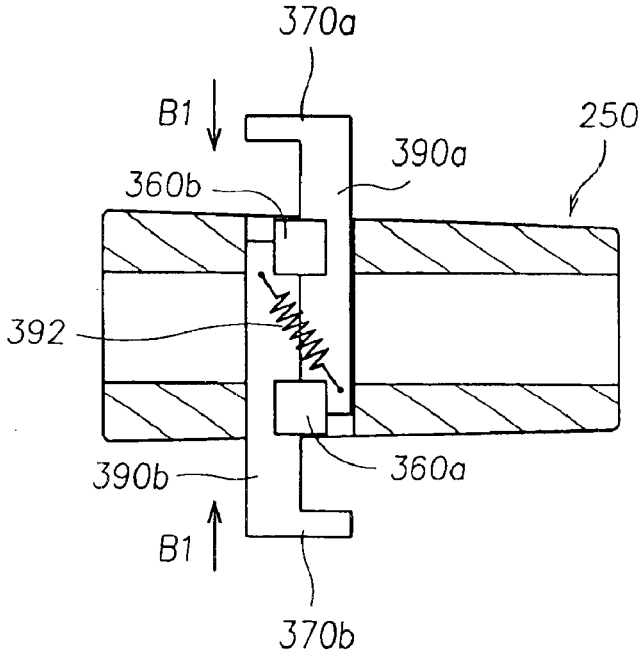
FIG. 11A is a top cross-sectional plan view of a connecting device according to another embodiment of the present invention shown with the control mechanism in the normal position.
Figure 11B:
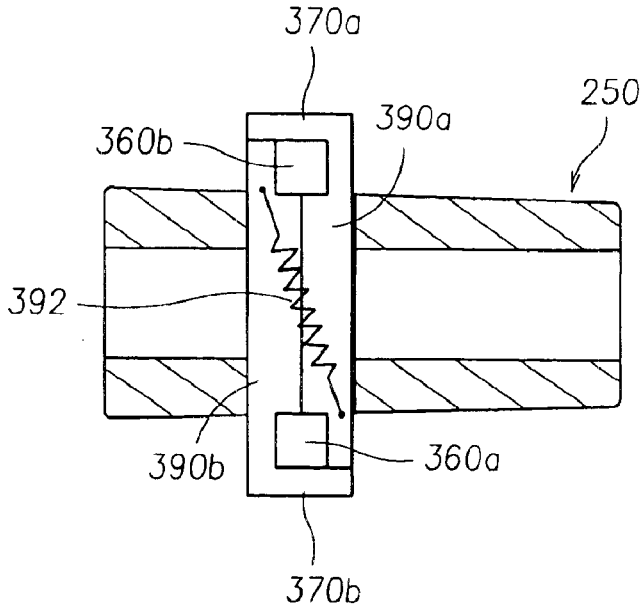
FIG. 11B is a top cross-sectional plan view of the connecting device of FIG. 11A shown with the control mechanism being actuated.
Figure 11C:
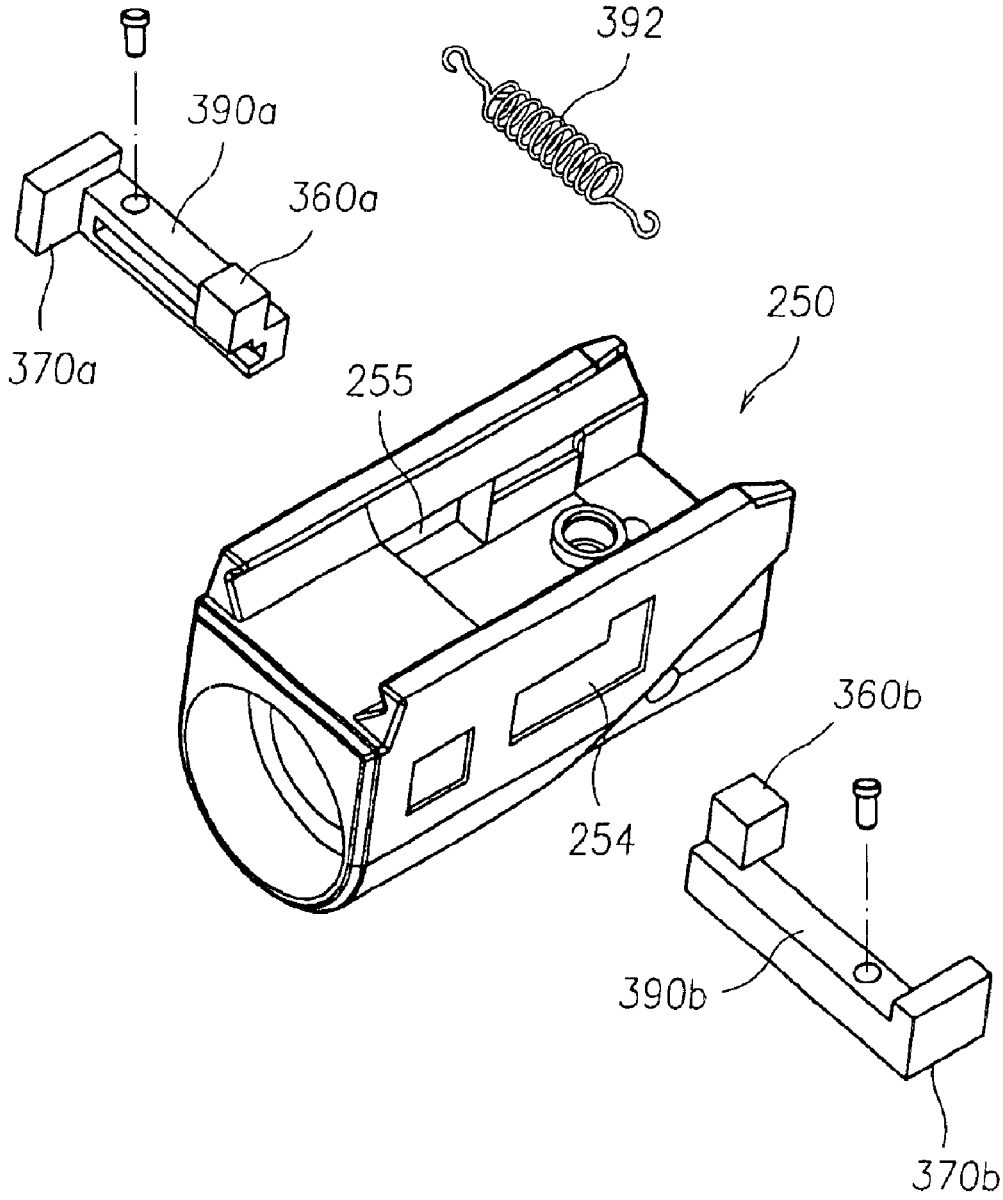
FIG. 11C is an exploded perspective view of the connecting device of FIG. 11A.

FIGS. 11A–11C illustrate another embodiment of the present invention where the seat 250 is used with a different control mechanism. In the embodiment in FIGS. 11A–11C, the control mechanism has two rods 390*a* and 390*b*, each having a gripping end 360*a* and 360*b*, respectively, that functions in the same manner as the sliding blocks 60*a* and 60*b*. Opposite each gripping end 360*a* and 360*b* is provided a pushing end 370*a* and 370*b*, respectively. The two rods 390*a*, 390*b* are positioned side-by-side along their lengths, with the pushing end 370*a* of the rod 390*a* positioned adjacent one opening 255 and the gripping end 360*a* of the rod 390*a* positioned adjacent the opposing aligned opening 254. Similarly, the pushing end 370*b* of the rod 390*b* is positioned adjacent one opening 254 and the gripping end 360*b* of the rod 390*b* positioned adjacent the opposing aligned opening 255. An inwardly-biased elastic component 392 has opposing ends that are secured to a different rod 390*a*, 390*b* adjacent the gripping ends 360*a*, 360*b*. The elastic component 392 normally biases the gripping ends 360*a*, 360*b* of the rods 390*a*, 390*b* towards each other, as shown in FIG. 11A. FIG. 11A also shows that the two gripping ends 360*a*, 360*b* extend through the openings 254 and 255 into the seat 250, and are disposed closest to each other, when the rods 390*a*, 390*b* are in their normal position (when the gripping ends 360*a*, 360*b* are biased towards each other by the elastic component 392). Thus, the two rods 390*a*, 390*b* move in a straight line adjacent to each other and in a direction opposite to each other, and in a direction transverse to the longitudinal axis of the seat 250.

When the user pushes the pushing ends 370*a*, 370*b* towards each other in the direction the arrows B1 in FIG. 11A against the normal bias of the elastic component 392, the gripping ends 360*a*, 360*b* will move away from each other so that the longitudinal groove of the weapon 30 can be placed between the gripping ends 360*a*, 360*b*. See FIG. 11B. When the user then releases the push on the pushing ends 370*a*, 370*b*, the elastic components 392*a*, 392*b* will bias the gripping ends 360*a*, 360*b* towards each other to grip a transverse groove 33 on the weapon 30, as shown in FIG. 11A. The grip on the transverse groove 33 can be released by pushing the pushing ends 370*a*, 370*b* in the direction of the arrows B1 in FIG. 11A.

Figure 12A:
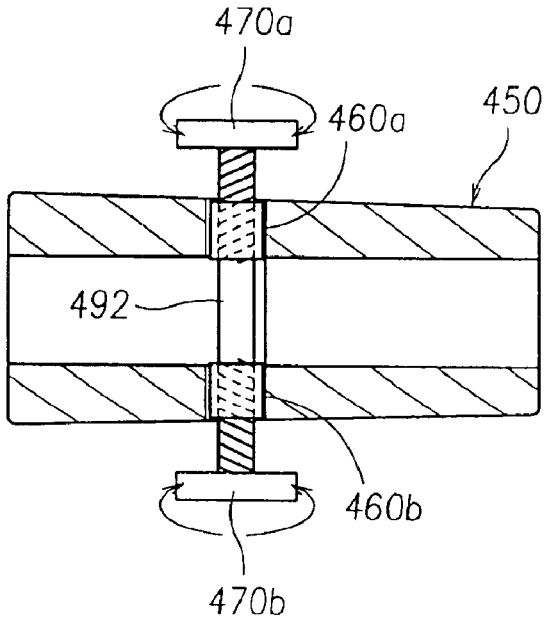
FIG. 12A is a top cross-sectional plan view of a connecting device according to another embodiment of the present invention shown with the control mechanism in the normal position.
Figure 12B:
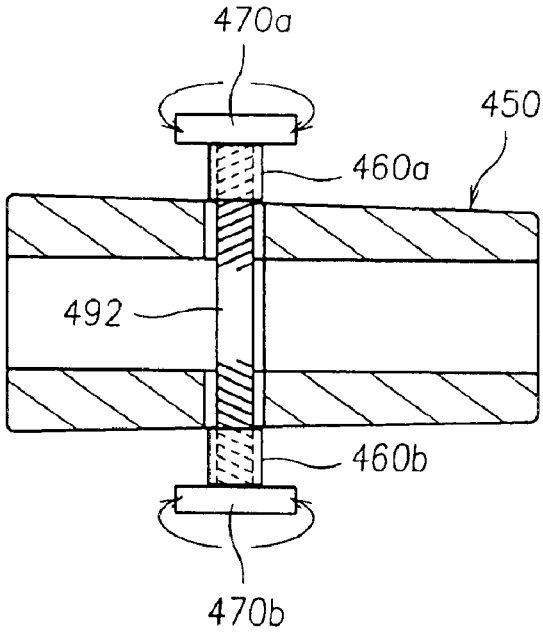
FIG. 12B is a top cross-sectional plan view of the connecting device of FIG. 12A shown with the control mechanism being manipulated.
Figure 12C:
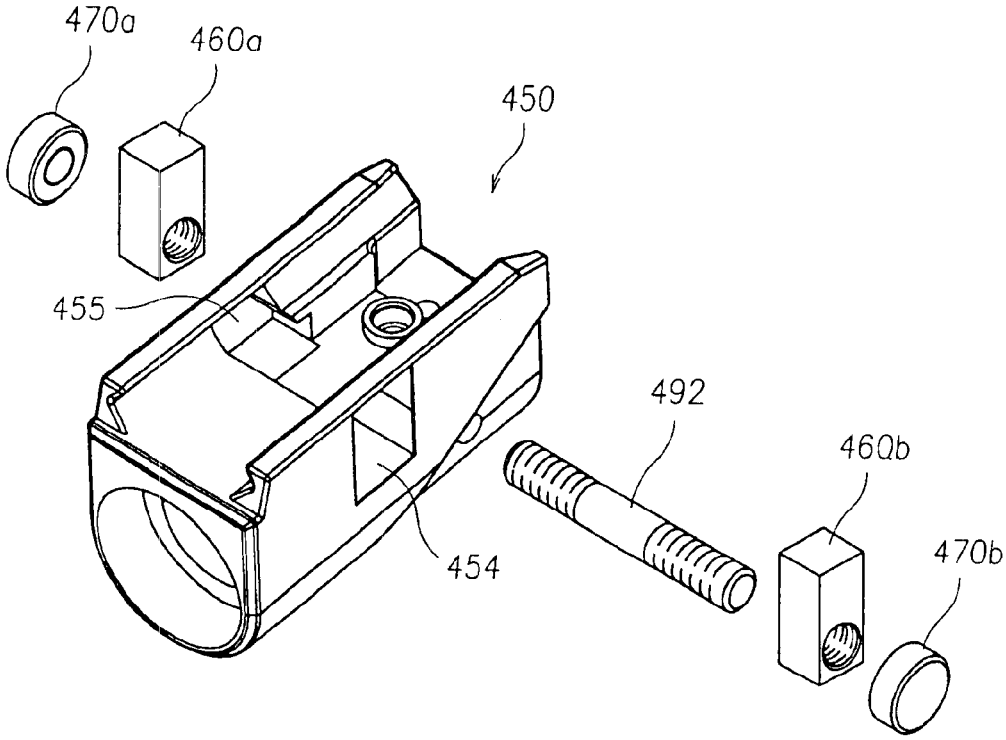
FIG. 12C is an exploded perspective view of the connecting device of FIG. 12A.

FIGS. 12A–12C illustrate another embodiment of the present invention where the seat 450 is similar to the seat 50, except that the aligned openings 454 and 455 in the seat 450 have a different shape than the aligned openings 54 and 55 in the seat 50. In the embodiment in FIGS. 12A–12C, the control mechanism includes a threaded screw 492 having opposing ends that can threadably receive two mounting blocks 460*a* and 460*b*. The screw 492 extends through the openings 454 and 455 of the seat 450, and the mounting blocks 460*a* and 460*b* extend through openings 455 and 454, respectively. Respective nuts 470*a* and 470*b* are threadably engaged at the opposite ends of the screw 492 and cooperate with the respective mounting blocks 460*a* and 460*b* to prevent the respective mounting blocks 460*a* and 460*b* from falling off the opposite ends of the screw 492. By threading the mounting blocks 460*a*, 460*b*, the user can vary the distance along the thread 492 between the two mounting blocks 460*a*, 460*b* so that the longitudinal groove of the weapon 30 can be placed between, and gripped by, the two mounting blocks 460*a*, 460*b*.

Although the various embodiments illustrated herein provide a pair of sliding or mounting blocks that are adapted to engage the weapon 30 along the opposing lateral sides of the weapon 30, the same engaging and disengaging purpose can be accomplished by using only one lateral sliding or mounting block.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A connecting device for a weapon accessory, comprising:

a seat having a sliding rack that removably connects a sliding groove of a weapon, the seat having two opposite side walls;

two gripping blocks disposed adjacent opposing side walls of the seat, each gripping block assuming a first position where the gripping block extends inwardly towards the sliding rack, and a second position where the gripping block extends outwardly away from the respective side wall of the seat;

a control mechanism operatively coupled to each gripping block;

wherein the control mechanism assumes a normal position with the control mechanism controlling each gripping block to maintain the gripping block in the first position; and wherein actuation of the control mechanism causes each gripping block to assume the second position.

2. The device of claim 1, wherein each gripping block has an angled top surface that communicates with an angled side surface, with the inclination of the angled surfaces extending from an outer side of the gripping block to an inner side thereof.

3. The device of claim 1, wherein the sliding rack of the seat has a front angled surface.

4. The device of claim 1, wherein the control mechanism includes a button and a first elastic component disposed between the gripping blocks.

5. The device of claim 4, further including a second elastic component disposed between the button and the seat, and normally biasing the button away from the gripping blocks.

6. The device of claim 4, further including a second elastic component disposed between the button and the seat, and normally biasing the button towards the gripping blocks.

7. The device of claim 4, wherein the button has a rear end having two outwardly-extending angled surfaces, and wherein each gripping block has an inwardly-extending angled surface that engages one of the two outwardly-extending angled surfaces, such that actuation of the button pushes the gripping blocks away from each other.

8. The device of claim 4, wherein the button has a rear end having two inwardly-extending angled surfaces, and wherein each gripping block has an outwardly-extending angled surface that engages one of the two inwardly-extending angled surfaces, such that actuation of the button causes the outwardly-extending angled surfaces to disengage the inwardly-extending angled surfaces.

9. The device of claim 1, wherein the control mechanism comprises:

two crossing bars that are pivoted with respect to each other about a pivot point, each bar having a first end that carries one of the gripping blocks, and a second end; and elastic components that are provided between each second end of the bars and the seat.

10. The device of claim 1, wherein the control mechanism comprises:

two adjacent bars that are pivoted with respect to each other about a pivot point, each bar having a first end that carries one of the gripping blocks, and a second end; and elastic components that are provided between each second end of the bars and the seat.

11. The device of claim 1, wherein the control mechanism comprises:

two adjacent rods that move in opposite directions, each rod having a first end that carries one of the gripping blocks, and a second end; and an elastic component that couples the two rods adjacent the first end to normally bias the gripping blocks towards each other.

12. The device of claim 1, wherein the control mechanism comprises:

a threaded screw having opposing first and second ends; and wherein each gripping block is threadably engaged to one of the first or second ends of the screw, and threadably manipulated along the screw to adjust the distance between the two gripping blocks.

13. A weapon assembly, comprising:

(a) a weapon having longitudinal groove and a plurality of transverse grooves provided along the longitudinal groove;

(b) a connecting device, comprising:

a seat having a sliding rack that removably connects the longitudinal groove of the weapon, the seat having two opposite side walls;

two gripping blocks disposed adjacent opposing side walls of the seat, each gripping block assuming a first position where the gripping block extends inwardly towards the sliding rack to engage a selected transverse groove of the weapon, and a second position where the gripping block extends outwardly away from the respective side wall of the seat to release the longitudinal groove of the weapon;

a control mechanism operatively coupled to each gripping block;

wherein the control mechanism assumes a normal position with the control mechanism controlling each gripping block to maintain each gripping block in the first position; and wherein actuation of the control mechanism causes each gripping block to assume the second position.

14. The assembly of claim 13, wherein the control mechanism includes a button and a first elastic component disposed between the gripping blocks.

15. The assembly of claim 14, further including a second elastic component disposed between the button and the seat, and normally biasing the button away from the gripping block.

16. The assembly of claim 14, further including a second elastic component disposed between the button and the seat, and normally biasing the button towards the gripping blocks.

17. The assembly of claim 14, wherein the button has a rear end having two outwardly-extending angled surfaces, and wherein each gripping block has an inwardly-extending angled surface that engages one of the two outwardly-extending angled surfaces, such that actuation of the button pushes the gripping blocks away from each other.

18. The assembly of claim 14, wherein the button has a rear end having two inwardly-extending angled surfaces, and wherein each gripping block has an outwardly-extending angled surface that engages one of the two inwardly-extending angled surfaces, such that actuation of the button causes the outwardly extending angled surfaces to disengage the inwardly-extending angled surfaces.

19. The device of claim 13, wherein the control mechanism comprises:

a threaded screw having opposing first and second ends; and wherein each gripping block is threadably engaged to one of the first or second ends of the screw, and threadably manipulated along the screw to adjust the distance between the two gripping blocks.

* * * * *